US005989468A

United States Patent [19]

Lundgren et al.

[11] Patent Number: 5,989,468

[45] Date of Patent: Nov. 23, 1999

[54] METHOD OF CONTINUOUS PRODUCTION OF LIGNOCELLULOSIC BOARDS

[75] Inventors: Göran Lundgren, Alnö; Kurt Schedin; Lars-Otto Sislegård, both of Sundsvall; Kjell Sjödin, Bergeforsen, all of Sweden

[73] Assignee: Sunds Defibrator Industries AB, Sweden

[21] Appl. No.: 09/000,295

[22] PCT Filed: Jul. 25, 1996

[86] PCT No.: PCT/SE96/00973

§ 371 Date: Jan. 26, 1998

§ 102(e) Date: Jan. 26, 1998

[87] PCT Pub. No.: WO97/04931

PCT Pub. Date: Feb. 13, 1997

[30] Foreign Application Priority Data

Jul. 27, 1995 [SE] Sweden ..... 95027124

[51] Int. Cl.[6] ..... B27N 3/08

[52] U.S. Cl. ..... 264/83; 264/109

[58] Field of Search ..... 264/83, 101, 109

[56] References Cited

U.S. PATENT DOCUMENTS

| | | | |
|---|---|---|---|
| 2,480,851 | 9/1949 | Goss . | |
| 4,684,489 | 8/1987 | Walter | 264/101 |
| 5,063,010 | 11/1991 | Fischer et al. | 264/109 |
| 5,433,905 | 7/1995 | Tisch | 264/83 |

FOREIGN PATENT DOCUMENTS

| | | |
|---|---|---|
| 2 058 820 | 5/1972 | Germany . |
| 36 40 682 A1 | 6/1988 | Germany . |
| 40 09 883 A1 | 10/1991 | Germany . |
| 999696 | 7/1965 | United Kingdom . |
| 95/31318 | 11/1995 | WIPO . |

*Primary Examiner*—Mary Lynn Theisen

*Attorney, Agent, or Firm*—Lerner, David, Littenberg, Krumholz & Mentlik, LLP

[57] ABSTRACT

Methods for the continuous production of compressed board are disclosed including drying lignocellulosic fibrous material, gluing the lignocellulosic fibrous material, forming a mat, and pre-compressing the mat by controllably adding steam to the mat in an amount such that the temperature of the mat is increased to between about 60 and 90° C.

17 Claims, 2 Drawing Sheets

METHOD OF CONTINUOUS PRODUCTION OF LIGNOCELLULOSIC BOARDS

FIELD OF THE INVENTION

The present invention relates to a method of producing lignocellulosic boards.

BACKGROUND OF THE INVENTION

Methods of producing boards of lignocellulosic material are well known and have significant practical applications. Such manufacturing methods include the following main steps: breaking up of the raw material into particles having a suitable size and/or fibers, drying to a predetermined moisture ratio, and gluing the material before or after the drying step, forming the glued material into a mat which may be constructed of several layers, possibly cold pre-compressing, preheating, water spraying of surfaces, etc., a heat compressing under pressure and heat in a stroke compressor or a continuous compressor until the board is finished.

During conventional heat compressing, the compressed material is primarily heated by using heat coils from adjacent heating plates or steel bands. These have a temperature of 150–200° Celsius depending on the type of product that is being compressed, the type of glue used, desired capacity, etc. In this way, the moisture in the material closest to the heat sources is evaporated so that a dry layer is developed in this area and the steam front gradually moves towards the center of the board from each side as compression continues. When the dry layer has been developed this means that the temperature in this layer is at least 100° Celsius, which initiates the curing of conventional glues. When the steam front has reached the center, the temperature at the center has reached at least 100° Celsius, and the board even starts to cure at its center so that the compression can be stopped within a couple of seconds. This applies to situations when conventional urea formaldehyde glue (UF) and similar glues are used, such as melamine fortified (MUF) glue. When other glues, having a higher curing temperature, are used, then a higher temperature and a greater steam pressure is required in the board before any curing can start.

To achieve the desired density, a compressor must apply a high surface pressure at a high temperature. This is not a problem for non-continuous compression in a so-called stroke compressor but such compressors have other drawbacks, such as worse thickness tolerances, etc. When continuous compressors are used, the requirement for high surface pressures and high temperatures at the same time have led to expensive high precision solutions with regard to the roller felt between the steel band and the heating plate positioned therebelow. The method of providing heat to the board by means of heat coils makes the heating relatively time consuming, which results in long compression lengths (large compression surfaces).

The heating can also be achieved by delivering steam to the mat to be compressed. In this way, the heating time is drastically shortened and, in addition, the resistance of the material to compression is drastically reduced when steam is introduced so that less compression forces and smaller compression surfaces are required. An injection box may be used to inject steam into the material mat which, however, has certain drawbacks. To avoid these drawbacks, compression rollers have been developed that are perforated and function as a steam delivery member. Such apparatus is disclosed in Swedish Patent No. 502,810.

The use of steam injection for heating the material is well known in the industry. For example, reference is made to European Patent No. 383,572; U.S. Pat. No. 2,480,851; British Patent No. 999,696; German Patent No. 2,058,820; German Patent Application Nos. 36 40 682 and 40 09 883; and Australian Patent No. 57390/86, which show different examples of how steam is injected during continuous processes to produce fiber boards.

According to the method of German Patent Application No. 36 40 682, the steam injection is applied during a pre-compression stage. Immediately after pre-compression, the material mat is passed near a steam box or a similar device where it is exposed to a steam flow to such an extent that the curing temperature of the binders are not exceeded, which normally means a temperature of between about 65 and 90° Celsius. The material is then compressed to a completed form while being exposed to additional heat so that it cures.

Because the steam in this method is injected after the actual pre-compression step and is mainly a preparation for subsequent treatment steps, it does not affect the condition of the material mat in the pre-compression step.

According to the method of German Patent Application No. 20 58 820, the steam is introduced during the actual pre-compression step. This can result in the temperature of the fiber mat being increased such that the glue or binders start to cure, which with conventional glues occurs at a temperature exceeding 100° Celsius. This creates problems for performing the subsequent treatment step.

The object of the present invention is to achieve pre-compression with steam delivery in such a way that the subsequent steps are not made more difficult to perform.

SUMMARY OF THE INVENTION

In accordance with the present invention, these and other objects have now been realized by the invention of a method for the continuous production of compressed board from lignocellulosic fibrous material which comprises providing the lignocellulosic fibrous material in the form of particles and/or fibers, drying the lignocellulosic fibrous material, gluing the lignocellulosic fibrous material, forming a mat from the lignocellulosic fibrous material and pre-compressing the mat of lignocellulosic fibrous material, the pre-compressing of the mat including controllably adding steam to the mat in an amount such that the temperature of the mat of lignocellulosic fibrous material is increased to a temperature of between about 60 and 95° C., and preferably between about 80 and 90° C.

In accordance with one embodiment of the method of the present invention, the pre-compressing step comprises compressing the mat of lignocellulosic fibrous material in at least one nip roller, and wherein the controllably adding of the steam to the mat includes introducing the steam through the at least one nip roller.

In accordance with another embodiment of the method of the present invention, the pre-compressing step includes compressing the mat of lignocellulosic fibrous material to a density of between about 100 and 500 kg/cm$^3$, and preferably about 300 kg/cm$^3$.

In accordance with another embodiment of the method of the present invention, the pre-compressing of the mat of lignocellulosic fibrous material includes compressing the mat to a first thickness, and the compressed board is further compressed to a second thickness, wherein said first thickness is between about 2 and 5 times the second thickness.

In accordance with another embodiment of the method of the present invention, the method includes pre-conditioning the mat of lignocellulosic fibrous material prior to the pre-compressing step. Preferably, the pre-conditioning step includes conditioning the mat to a predetermined temperature, moisture content and density.

By introducing steam in connection with the pre-compression step at a temperature as specified in the mentioned interval the spring back characteristics of the fibers are reduced due to the increase in temperature and to a certain extent due to the increase in the moisture content without causing any substantial curing of the glues that are used, which does not make the final compression more difficult to perform.

In view of the above-described method of the present invention, is now possible to achieve pre-compression to a smaller thickness compared to pre-compression according to the prior art. In the alternative, the effect on the fiber material that is accomplished may be used by being able to build a pre-compressor that has smaller dimensions compared to today's pre-compressors.

In addition, the finishing compressor may be built with a shorter compression zone because of the smaller thickness of the fiber member after it has been pre-compressed according to the present invention. By raising the temperature during the pre-compression step, the finishing compressor can otherwise be built with a shorter curing zone.

In summary, these advantages result in a manufacturing process that is substantially more cost effective compared to the conventional technology of the prior art.

According to a preferred embodiment of the present invention, the steam is directly introduced through the roller or the rollers that are used for the pre-compression. In this way, drawbacks are avoided that are associated with delivering steam the conventional way, such as by using a steam box or a similar device. In conventional steam delivery systems, the fiber mat/weave may slide relative to the steam box so that substantial wear can occur, resulting in the sliding surfaces of the box having to be replaced at regular intervals and where problems with the sealing of the edges may occur as a result of the sliding of the fiber may/weave relative to the steam box.

In an alternative embodiment of the present invention, the advantages of this method are utilized by substantially reducing the thickness of the mat at the pre-compression stage so that the thickness corresponds o a thickness that is 2–3 times the final thickness of the fiber board.

BRIEF DESCRIPTION OF THE DRAWINGS

The method of the present invention is described in more detail below in the detailed description of a preferred embodiment of the invention with reference to the appended figures where.

DETAILED DESCRIPTION

Figure 1:
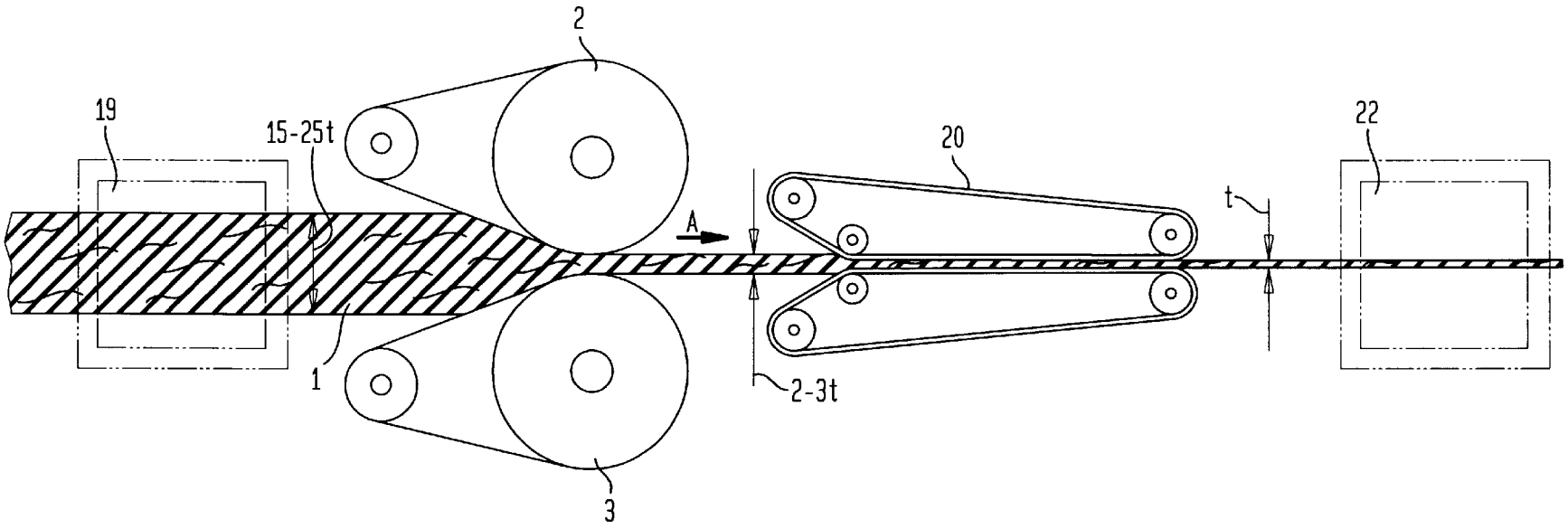
FIG. 1 is a schematic cross-sectional view along the length of an apparatus for using the method of the present invention.

The mat 1, as shown in FIG. 1, includes particles of a suitable size and/or fibers, glue, etc. that are conveyed in the direction of an arrow A of the figure. Before any compression takes place, the mat 1 is passed through a pre-conditioning zone 19 where it is conditioned to a predetermined temperature, moisture content and density. The mat is then conveyed in between a pair of rollers, 2 and 3, to be pre-compressed, and is there compressed from a thickness that corresponds to 15–25 times the thickness of the final board to a thickness that corresponds to 2–3 times the thickness of the final board. That is, the mat is compressed down to about 10% of its initial thickness.

During the pre-compression step, steam is introduced, which is conventionally carried out by means of a steam box. According to a preferred embodiment of the present invention, the steam is directly introduced through one or both of the pre-compression rollers, 2 and 3.

The introduction of steam is regulated so that the temperature of the fiber mat is between 60–95° Celsius, preferably 80–90° Celsius, due to the introduction of the stream. Due to the temperature increase and to a certain extent due to an increase in the moisture content which the introduction of steam provides, the spring back characteristics of the fiber mat are reduced, so that its resistance to compression is reduced. By insuring that the temperature increase does not exceed the mentioned temperatures, it, at the same time, prevents the curing of the glues that are normally used because a temperature exceeding 100° Celsius must be reached before any considerable curing of the glues takes place. When the steam is injected, the fiber mat should have a density of 100–500 kilogram/cubic meter, preferably about 300 kilogram/cubic meter. Any air contained in the fiber mat is pushed backwardly by the steam, i.e. in the opposite direction of conveyance of the mat.

From the pre-compression, the mat is conveyed further to a finishing compressor 20 to be compressed to the thickness of the finished board. The distance between the pre-compressors, 3 and 3, and the finishing compressor 20 should be as small as possible to minimize the cooling that occurs during transportation therebetween.

The finishing compressor 20 has a shorter compression zone than normal in view of the substantial reduction of the thickness of the fiber mat that takes place in the pre-compression step according to the method of the present invention. In addition, the curing zone is shorter than normal because the inlet temperature in the finishing compressor 20 is higher than that which is common according to the prior art techniques.

After the finishing compressor 20, the board material is passed through an after conditioning zone of a conventional type where the board is also cooled.

Figure 2:
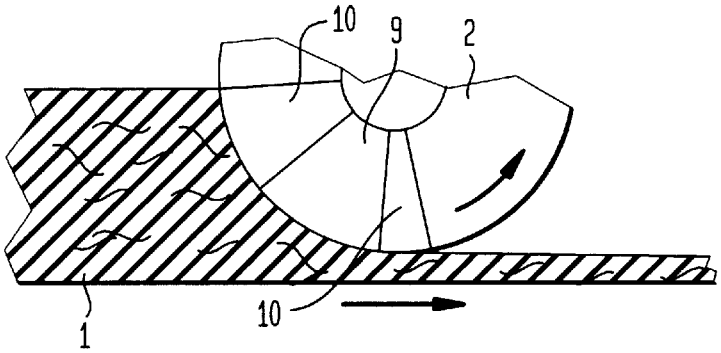
FIG. 2 is a schematic cross-sectional view through a roller through which steam is introduced.
Figure 3:
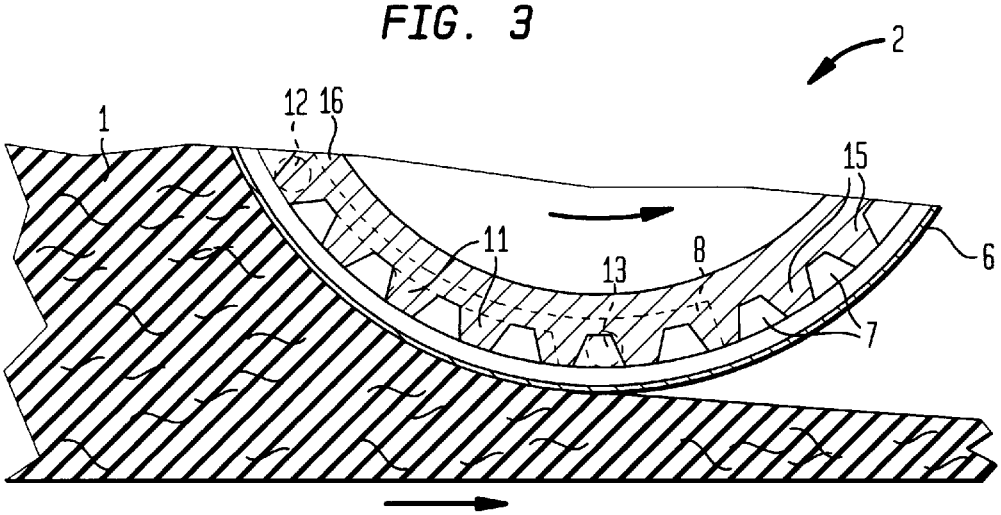
FIG. 3 is a cross-sectional view through a portion of the roller of FIG. 2.
Figure 4:
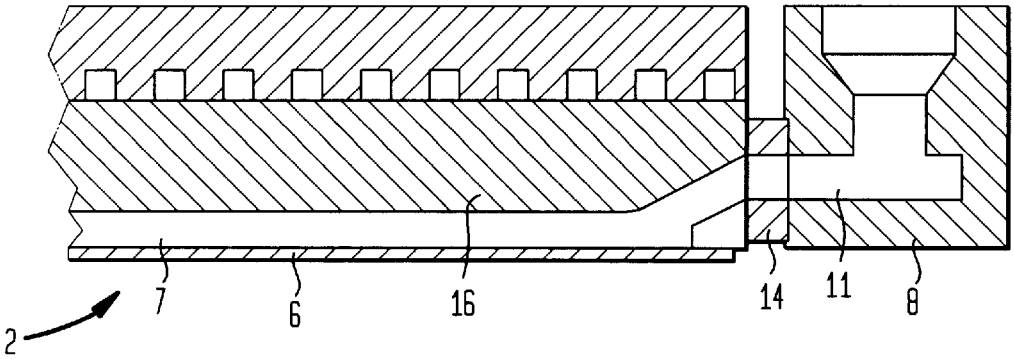
FIG. 4 is an axial cross-sectional view of a portion of the roller of FIG. 3.

Both or either of the rollers, 2 and 3, can be constructed according to the method that is described in Swedish Patent No. 502,810 and that is illustrated in FIGS. 2, 3 and 4.

The compression and injection roller 2 that is shown in FIG. 3 is constructed with a perforated casing surface 6 for delivering steam to the mat 1. An axial channel system 7 is disposed inside the casing surface 6 around the roller 2. The channel system 7 is adapted to distribute the steam over the roller 2 and thus along the width of the mat 1. An adjustable sliding shoe (FIG. 4) is arranged to sealingly engage an end of the roller 2 in order to introduce steam into the channel system 7. The introduction of steam is thus performed to a limited section (FIG. 2) of the roller 2 where the mat 1 is compressed. The limited sector 9 is surrounded on both sides, a seen in the periphery, by sealing zones 10 where the roller 2 is in contact with the mat 1. The channel system 7 can be closed at the opposite end of the roller 2. In the alternative, a sliding shoe 8 can be disposed at each of the ends.

The sliding shoe 8 is held in place by an adjustable stand so that the sliding shoe is adjustable along the direction of the periphery. In this manner, the position of the injection sector 9 can be varied. The sliding shoe 8 preferably includes a replaceable wear part 14 made of a low friction material that bears against a treated surface on the end of the roller 2. Thus, the sliding shoe 8 is held and pushed against the end of the roller 2 by, for example, springs, compressed air or hydraulically, so that any leakage in the sealing surface is minimized.

The sliding shoe 8 can be constructed with one or more channels 11, 12, 13 that can have different surface areas. Even replaceable wear parts 14 having different openings defined therein may be used, such as a sliding plate having an opening that can be varied. Thus, the size of the injection sector 9 can be varied. In addition, different flows and pressures can be maintained in different parts of the injection sector 9. The channels of the sliding shoe 8 can also be used for cleaning and suction.

FIG. 4 schematically shows the contact surface of the sliding shoe 8 against the end of the roller 2. In this way, the sliding shoe 8 is equipped with injection channels 11 for steam, cleaning channel 12 and suction channel 13.

The perforated casing surface 6 on the roller 2 can be stamped or drilled sheet metal having the shape of rings that have been heat shrunk onto the roller. Axial support moldings 15 for the sheet metal can be shaped into the casing sheet metal 16 on the roller by milling or casting or the sheet metal may be constructed as separate moldings that are attached to recesses in the casing sheet metal 16. These moldings can at the same time limit the channel system 7 disposed inside the casing surface 6.

The openings of the channel system 7 at the end of the roller that have not been covered by the sliding shoe 8 can be sealed by pressing an adjustable sliding ring made of a low friction material against the end.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A method for the continuous production of compressed board from lignocellulosic fibrous material comprising providing said lignocellulosic fibrous material in the form of particles and/or fibers, drying said lignocellulosic fibrous material, gluing said lignocellulosic fibrous material, forming a mat from said lignocellulosic fibrous material and pre-compressing said mat of lignocellulosic fibrous material, said pre-compressing of said mat including compressing and simultaneously controllably adding steam to said mat in an amount such that the temperature of said mat of lignocellulosic fibrous material is increased to a temperature of between about 60 and 95° C.

2. The method of claim 1 including controllably adding steam to said mat in an amount such that the temperature of said mat of lignocellulosic fibrous material is increased to a temperature of between about 80 and 90° C.

3. The method of claim 1 wherein said pre-compressing step comprises compressing said mat of lignocellulosic fibrous material in at least one nip roller, and wherein said controllably adding said steam to said mat includes introducing said steam through said at least one nip roller.

4. The method of claim 1 wherein said pre-compressing step includes compressing said mat of lignocellulosic fibrous material to a density of between about 100 and 500 kilograms per cubic meter.

5. The method of claim 4 wherein said pre-compressing step includes compressing said mat of lignocellulosic fibrous material to a density of about 300 kilograms per cubic meter.

6. The method of claim 1 wherein said pre-compressing of said mat of lignocellulosic fibrous material includes compressing said mat to a first thickness, and wherein said compressed board is further compressed to a second thickness, wherein said first thickness is between about 2 and 5 times said second thickness.

7. The method of claim 1 including pre-conditioning said mat of lignocellulosic fibrous material prior to said pre-compressing step.

8. The method of claim 7 wherein said pre-conditioning step includes conditioning said mat to a predetermined temperature, moisture content and density.

9. The method of claim 1 including finally compressing said mat to form a compressed board.

10. The method of claim 9 including minimizing the cooling of said compressed mat between said pre-compressing and said final compressing steps.

11. A method for the continuous production of compressed board from lignocellulosic fibrous material comprising providing said lignocellulosic fibrous material in the form of particles and/or fibers, drying said lignocellulosic fibrous material, gluing said lignocellulosic fibrous material, forming a mat from said lignocellulosic fibrous material and pre-compressing said mat of lignocellulosic fibrous material, said pre-compressing of said mat including compressing said mat of lignocellulosic fibrous material in at least one nip roller and controllably adding steam to said mat including introducing said steam to said at least one nip roller in an amount such that the temperature of said mat of lignocellulosic fibrous material is increased to a temperature of between about 60 and 95° C.

12. A method for the continuous production of compressed board from lignocellulosic fibrous material comprising providing said lignocellulosic fibrous material in the form of particles and/or fibers, drying said lignocellulosic fibrous material, gluing said lignocellulosic fibrous material, forming a mat from said lignocellulosic fibrous material and pre-compressing said mat of lignocellulosic fibrous material, said pre-compressing of said mat including compressing said mat of lignocellulosic fibrous material to a density of between about 105 and 500 kilograms per cubic meter and controllably adding steam to said mat in an amount such that the temperature of said mat of lignocellulosic fibrous material is increased to a temperature of between about 60 and 95° C.

13. The method of claim 12 wherein said pre-compressing step includes compressing said mat of lignocellulosic fibrous material to a density of about 300 kilograms per cubic meter.

14. A method for the continuous production of compressed board from lignocellulosic fibrous material comprising providing said lignocellulosic fibrous material in the form of particles and/or fibers, drying said lignocellulosic fibrous material, gluing said lignocellulosic fibrous material, forming a mat from said lignocellulosic fibrous material and pre-compressing said mat of lignocellulosic fibrous material, said pre-compressing of said mat including compressing said mat to a first thickness and controllably adding steam to said mat in an amount such that the temperature of said mat of lignocellulosic fibrous material is increased to a temperature of between about 60 and 95° C. and wherein said compressed board is further compressed to a second thickness, wherein said first thickness is between about 2 and 5 times said second thickness.

15. A method for the continuous production of compressed board from lignocellulosic fibrous material comprising providing said lignocellulosic fibrous material in the form of particles and/or fibers, drying said lignocellulosic fibrous material, gluing said lignocellulosic fibrous material, preconditioning said mat of lignocellulosic fibrous material, and subsequently pre-compressing said mat of lignocellulosic fibrous material, said pre-compressing of said mat including controllably adding steam to said mat in an amount such that the temperature of said mat of lignocellulosic fibrous material is increased to a temperature of between about 60 and 95° C. mat from said lignocellulosic fibrous material and pre-compressing said mat of lignocellulosic fibrous material, said pre-compressing of said mat including controllably adding steam to said mat in an amount such that the temperature of said mat of lignocellulosic fibrous material is increased to a temperature of between about 60 and 95° C.

16. The method of claim 15 wherein said preconditioning step including conditioning said mat to a predetermined temperature, moisture content and density.

17. A method for the continuous production of compressed board from lignocellulosic fibrous material comprising providing said lignocellulosic fibrous material in the form of dried particles and/or fibers, gluing said dried lignocellulosic fibrous material, forming a mat from said glued lignocellulosic fibrous material, pre-compressing said mat of lignocellulosic fibrous material, including compressing and simultaneously controllably adding steam to said mat in an amount such that the temperature of said mat of lignocellulosic fibrous material is increased to a temperature of between about 60 and 95° C., and finally compressing said mat to form a compressed board.

* * * * *

UNITED STATES PATENT AND TRADEMARK OFFICE

CERTIFICATE OF CORRECTION

PATENT NO. : 5,989,468

DATED : November 23, 1999

INVENTOR(S) : Lundgren et al.

It is certified that error appears in the above-identified patent and that said Letters Patent is hereby corrected as shown below:

Column 3, line 14, "is" should read --It--.
Column 3, line 40, "may" (second occurrence) should read --mat--.
Column 3, line 45, after "corresponds," "o" should read --to--.
Column 4, line 34, "3" (first occurrence) should read --2--.
Column 4, line 63, after "sides," "a" should read --as--.
Column 7, line 15, cancel "mat from said lignocellulosic".
Column 7, cancel lines 16-19.
Column 8, cancel lines 1-2.

Signed and Sealed this

Nineteenth Day of September, 2000

*Attest:*

Q. TODD DICKINSON

*Attesting Officer*

*Director of Patents and Trademarks*